US005701858A

United States Patent [19]

Moriya

[11] Patent Number: 5,701,858

[45] Date of Patent: Dec. 30, 1997

[54] VARIABLE VALVE TIMING MECHANISM OF ENGINE

[75] Inventor: Yoshihito Moriya, Nagoya, Japan

[73] Assignee: Toyota Jidosha Kabushiki Kaisha, Toyota, Japan

[21] Appl. No.: 805,525

[22] Filed: Feb. 26, 1997

[30] Foreign Application Priority Data

Feb. 27, 1996 [JP] Japan ..... 8-039948

[51] Int. Cl.[6] ..... F01L 1/344

[52] U.S. Cl. ..... 123/90.17; 123/90.31

[58] Field of Search ..... 123/90.15, 90.17, 123/90.31; 75/567, 568 R; 464/1, 2, 160

[56] References Cited

U.S. PATENT DOCUMENTS 5,301,639 4/1994 Satou ..... 123/90.17
5,483,930 1/1996 Moriya et al. ..... 123/90.17
5,592,909 1/1997 Tsuruta ..... 123/90.17
5,592,910 1/1997 Suga et al. ..... 123/90.17

*Primary Examiner*—Weilun Lo
*Attorney, Agent, or Firm*—Kenyon & Kenyon

[57] ABSTRACT

A variable valve timing control device includes a camshaft for actuating an intake valve, and an inner gear is provided with the distal end of the camshaft. A sprocket having a first surface and a second surface surrounds the inner gear. A ring gear is placed between the camshaft and the sprocket. A cover is fixed to the inner gear, and the cover defines a first hydraulic pressure chamber between it and the inner gear. A flange is provided with the inner gear, and the cover defines a second hydraulic pressure chamber. A first clearance is defined between the first surface and the cover and communicates with the first hydraulic pressure chamber. A second clearance is defined between the second surface and the flange and communicates with the second hydraulic pressure chamber. An intermediate surface is provided on the sprocket, facing a direction opposite to that faced by the second surface in the second hydraulic pressure chamber. The intermediate surface has an area greater than that of the second surface.

11 Claims, 3 Drawing Sheets

VARIABLE VALVE TIMING MECHANISM OF ENGINE

BACKGROUND OF THE INVENTION

1. Field of the Invention

The present invention relates to a variable valve timing mechanism for changing the valve timing of an intake valve or an exhaust valve. More particularly, the present invention pertains to a variable valve timing mechanism that is driven by fluid pressure.

2. Description of the Related Art

A variable valve timing mechanism (hereafter referred to as VVT) is provided in an engine to displace the rotational phase of a camshaft and adjust the valve timing of either an intake valve or an exhaust valve. The operation of the VVT optimizes the valve timing in accordance with the operating state of the engine (engine load, engine speed, and other factors). This improves fuel economy, increases engine power, and suppresses undesirable engine emissions regardless of different operating states of the engine. U.S. Pat. No. 5,483,930 describes a typical VVT.

The VVT described in the above publication is shown in FIG. 4. As shown in the drawing, a VVT 61 includes a valve train 62 that is driven by hydraulic power.

As shown in FIG. 4, a cylinder head 64 rotatably supports a camshaft 63. The camshaft 63 drives an intake valve (not shown). A pulley 65 is fit on the camshaft 63 and supported in a manner allowing relative rotation between the pulley 65 and the camshaft 63. The pulley 65 and a crankshaft 66 are connected to each other by a belt 67. A cover 68 is fixed to the pulley 65 to cover one side of the pulley 65 and the distal end of the camshaft 63. Inner teeth 69 project from the inner circumferential surface of the cover 68.

An inner cap 72 is fixed to the distal end of the camshaft 63 by a hollow bolt 70 and a pin 71. Outer teeth 73 project from the outer circumferential surface of the inner cap 72. A ring gear 74 is arranged between the cover 68 and the cap 72. The ring gear 74 is supported in a manner allowing relative rotation between the cover 68 and the cap 72. Inner teeth 75 project from the inner circumferential surface of the ring gear 74 while outer teeth 76 project from the outer circumferential surface of the ring gear 74. The inner and outer teeth 75, 76 are helical splines. The inner teeth 75 are meshed with the outer teeth 73 of the cap 72 while the outer teeth 76 are meshed with the inner teeth 69 of the cover 68.

A first hydraulic pressure chamber 77 is defined in the cover 68 at the left side (as viewed in the drawing) of the ring gear 74 while a second hydraulic pressure chamber 78 is defined at the right side. A first oil passage 79 and a second oil passage 80 extend through the camshaft 63. The first oil passage 79 is connected with the first pressure chamber 77 while the second oil passage 80 is connected with the second pressure chamber 78.

A flange 63*a* is defined on the camshaft 63. A predetermined clearance 82 is provided between the flange 63*a* and the pulley 65 to allow relative rotation between the camshaft 63 and the pulley 65. In the same manner, a predetermined clearance 81 is provided between the cap 72 and the pulley 65 to allow relative rotation therebetween.

The rotation of the crankshaft 66 is transmitted to the pulley 65 through the belt 67. The rotation of the pulley 65 is transmitted to the cap 72 and the camshaft 63 through the ring gear 74.

Hydraulic pressure is conveyed to the pressure chambers 77, 78 through the corresponding oil passages 79, 80 and applied to the associated side of the ring gear 74. The difference between the hydraulic pressures applied to each side of the ring gear 74 moves the gear 74 toward the right or toward the left (as viewed in the drawing) in the axial direction of the camshaft 63 as it rotates. The clearances 81, 82 allow the camshaft 63 and the cap 72 to rotate relative to the pulley 65. This alters the rotational phase of the camshaft 63 with respect to the pulley 65. Accordingly, the alteration in the rotational phase of the camshaft 63 adjusts the valve timing of the intake valve.

A predetermined torque is produced when the camshaft 63 is rotated. The torque of the camshaft 63 includes a positive torque acting in the rotating direction of the camshaft 63 and a negative torque acting in a direction opposite of the rotating direction of the camshaft 63. The negative torque is produced by the reaction force of a valve spring (not shown) when the intake valve is moved downward by the camshaft 63. The positive and negative torque of the camshaft 63 cause torque fluctuation, which has a tendency to become larger as the number of cylinders provided in the engine becomes smaller. The torque fluctuation is transmitted to the ring gear 74 through the outer teeth 73 of the cap 72 and the inner teeth 75 of the ring gear 74. Since the inner teeth 75 of the ring gear 74 are helical splines, the torque fluctuation of the camshaft 63 is converted to an axial force acting on the ring gear 74 and causes axial vibrations of the gear 74. The vibration of the ring gear 74 causes the pulley 65 to chatter within the space defined by the clearances 81, 82. As a result, the chattering may produce noise from the VVT 61.

SUMMARY OF THE INVENTION

Accordingly, it is an objective of the present invention to provide a variable valve timing mechanism for an engine that reduces noise produced by chattering between members that are rotatable with respect to a camshaft.

To achieve the above objective, the present invention is provided with an apparatus for adjusting the valve timing of at least one of an intake valve and an exhaust valve of an engine. The apparatus includes a camshaft, a rotary member, a gear member, a first cover, a second cover, a first clearance, a second clearance, and a third surface. The camshaft actuates one of the intake valve and the exhaust valve. The rotary member surrounds a distal end of the camshaft and has a first surface and a second surface for respectively receiving hydraulic pressure from opposite directions. The gear member is positioned between the camshaft and the rotary member. Furthermore, the gear member is arranged to move in an axial direction to change the relative rotational relationship between the camshaft and the rotary member. The first cover is fixed to the distal end of the camshaft and defines a first chamber between the first cover and the first surface of the rotary member for receiving hydraulic pressure to move the gear member axially. The second cover is fixed to the camshaft and defines a second chamber between the second cover and the second surface of the rotary member for receiving hydraulic pressure to move the gear axially. The first clearance is defined between the first surface and the first cover to communicate with the first chamber. The second clearance is defined between the second surface and the second cover to communicate with the second chamber. The third surface is provided on the rotary member between the first surface and the second surface and is arranged to receive a force resulting from hydraulic pressure directed opposite to a force resulting from the hydraulic pressure received by the second surface. The third surface has an area greater than that of the second surface.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION

A first embodiment of a variable valve timing mechanism (hereafter referred to as a VVT) for an engine according to the present invention will hereafter be described with reference to FIGS. 1 to 3.

Figure 3:
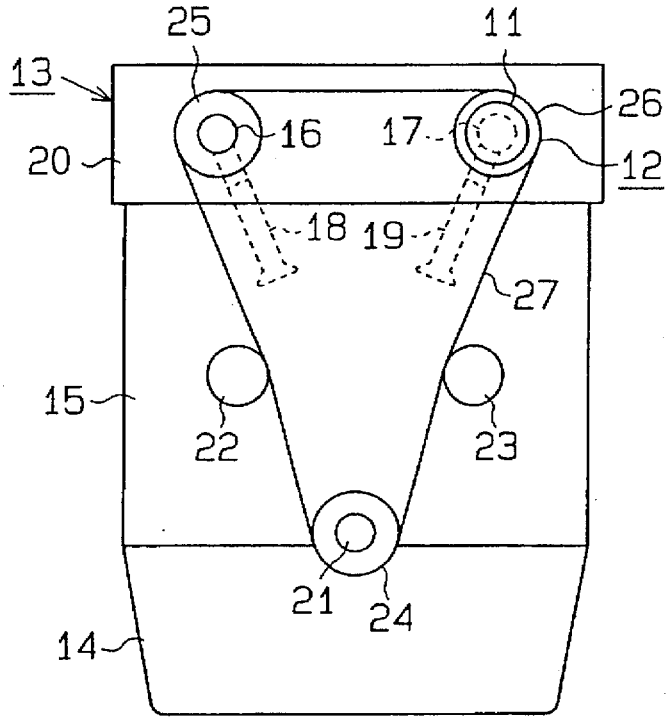
FIG. 3 is a diagrammatic front view showing an engine provided with the variable valve timing mechanism of FIG. 1.
Figure 4:
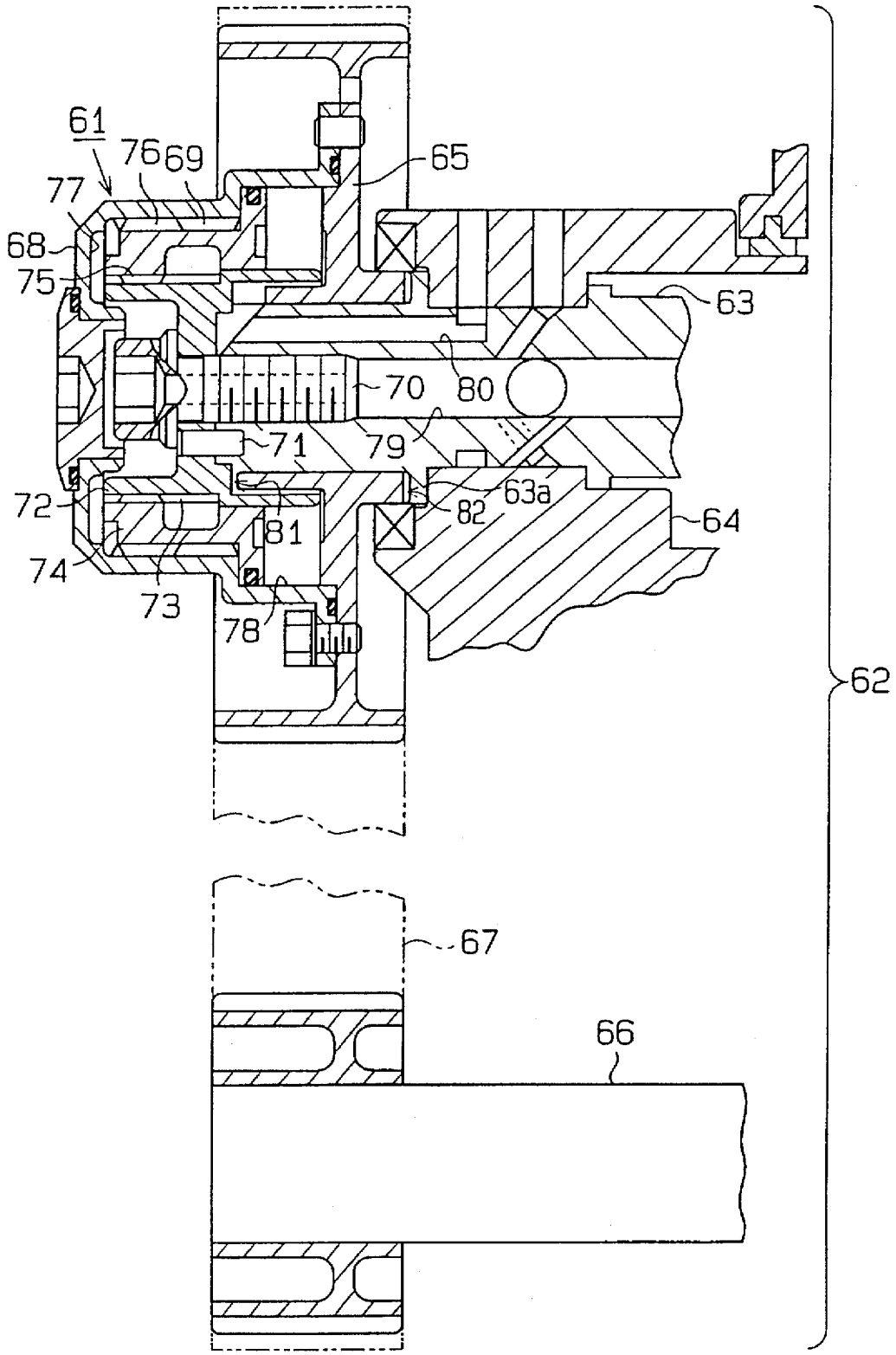
Fig.4(Prior Art)
FIG. 4 is a cross-sectional view showing a prior art variable valve timing mechanism.

An engine 13 having a valve train 12 that includes a VVT 11 is shown in FIG. 3. The engine 13 includes an oil pan 14 for reserving lubricating oil, a cylinder block 15 provided with cylinders (not shown), and a cylinder head 20. The cylinder head 20 supports camshafts 16, 17. Exhaust and intake valves 18, 19 are connected to the camshafts 16, 17, respectively.

The cylinder block 15 rotatably supports a crankshaft 21. Tensioners 22, 23 are arranged at predetermined positions on the cylinder block 15. The cylinder head 20 rotatably supports the camshaft 16 so as to open and close the exhaust valve 18. The cylinder head 20 also rotatably supports the camshaft 17 so as to open and close the intake valve 19. The VVT 11 is provided at a distal end of the camshaft 17. Sprockets 24, 25, 26 are provided at distal ends of the crankshaft 21, the camshaft 16, and the VVT 11, respectively. A chain 27 is wound about the sprockets 24, 25, 26. Tension is applied to the wound chain 27 by the tensioners 22, 23.

Accordingly, the rotation of the crankshaft 21 is transmitted to the camshafts 16, 17 by means of the chain 27 and the sprockets 24, 25, 26. This rotates the camshafts 16, 17 synchronously with the crankshaft 21. The rotation of the camshafts 16, 17 selectively opens and closes the associated exhaust and intake valves 18, 19 with a predetermined timing.

Figure 1:
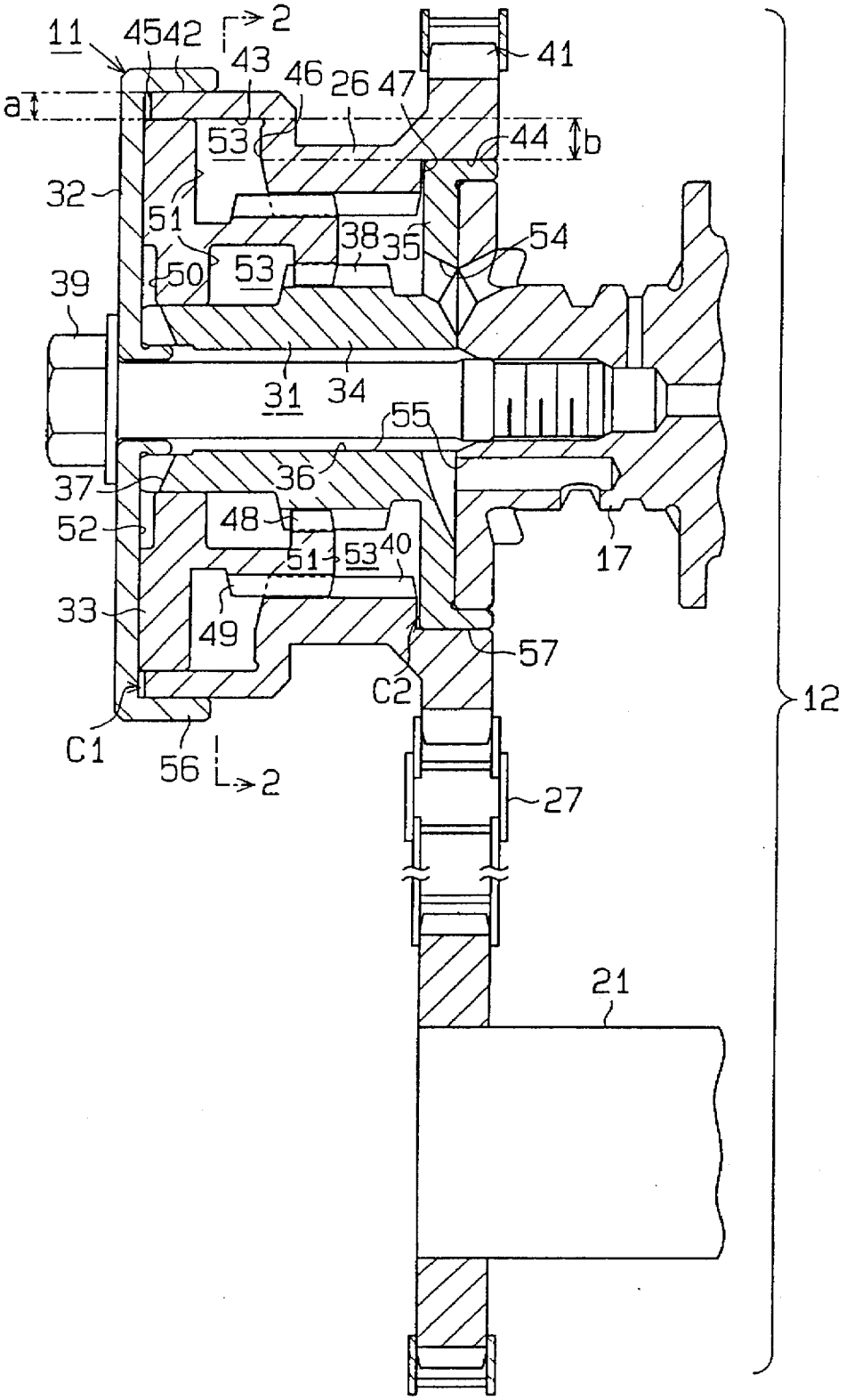
FIG. 1 is a cross-sectional view showing a variable valve timing mechanism according to the present invention.
Figure 2:
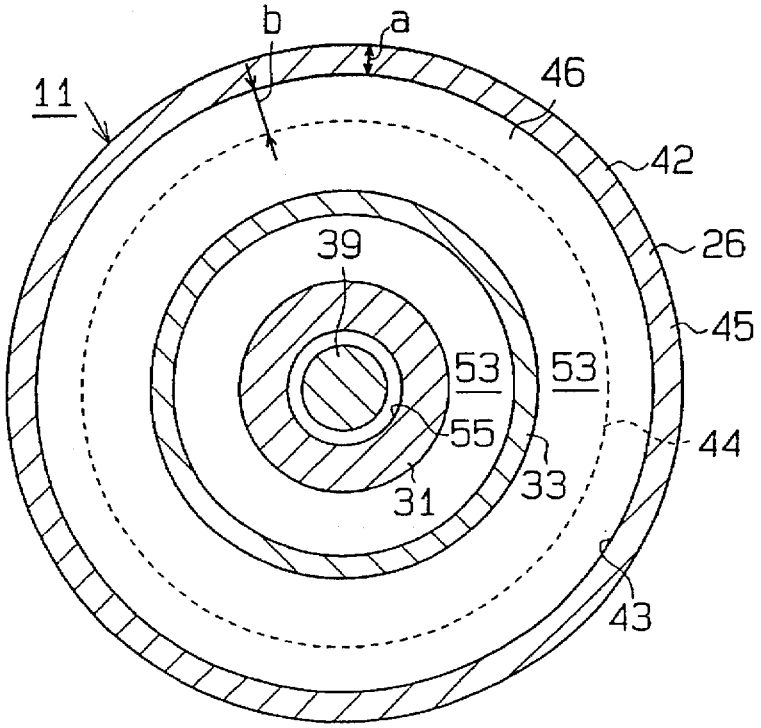
FIG. 2 is a cross-sectional view taken along line 2—2 in FIG. 1.

FIG. 1 partially shows the valve train 12 that is provided with the VVT 11. FIG. 2 is a cross-sectional view taken on line 2—2 in FIG. 1. In FIG. 1, the distal end of the VVT 11 is shown toward the left while the proximal side of the VVT 11 is shown toward the right. The VVT 11 includes the camshaft 17, an inner gear 31, the sprocket, or rotary member 26, a cover 32, and a ring gear 33.

The inner gear 31, which is substantially cylindrical, is fitted onto the distal end of the camshaft 17 and supported so as to rotate integrally with the camshaft 17. The inner gear 31 is constituted by a boss 34, a flange 35, and a first peripheral edge 57. The boss 34 extends in the axial direction of the camshaft 17 and has a through hole 36 extending therethrough in the axial direction. A plurality of oil grooves 37 are defined at the distal end of the boss 34. The oil grooves 37 are connected with the through hole 36. Outer teeth 38 project from the outer circumferential surface of the boss 34. The flange 35 is substantially disc-like and extends in a direction perpendicular to the boss 34. The first peripheral edge 57, which is an annular lip defined on the outer circumferential surface of the flange 35, extends in the axial direction of the camshaft 17 and is fitted in the sprocket 26.

The cover 32 is substantially disk-like and fixed to the camshaft 17 by a bolt 39. Thus, the camshaft 17, the inner gear 31, and the cover 32 rotate integrally. A second peripheral edge 56, which is an annular lip defined on the circumferential surface of the cover 32, extends in the axial direction of the camshaft 17 and is fitted onto the sprocket 26.

The sprocket 26 is substantially cylindrical and arranged so as to encompass the inner gear 31. The sprocket 26 rotates relative to the inner gear 31 and the cover 32. The inner gear 31 and the cover 32 restrict axial movement of the sprocket 26. A plurality of inner teeth 40 project from the inner circumferential surface of the sprocket 26 while a plurality of outer teeth 41 project from the outer circumferential surface of the sprocket 26. The sprocket 26 has an outer surface 42, which is fitted into the second peripheral edge 56, a first inner surface 43, which is opposite to the outer surface 42, and a second inner surface 44, which is fitted onto the first peripheral edge 57. The sprocket 26 also has a first end surface 45, which faces the cover 32, a second end surface 47, which faces the flange 35, and an intermediate surface 46, which is located between the end surfaces 45, 47. The intermediate surface 46 faces a direction that is substantially the opposite to the direction towards which the end surface 47 faces.

A first clearance C1 is provided between the cover 32 and the first end surface 45. In the same manner, a second clearance C2 is provided between the flange 35 and the second end surface 47. The length of the clearances C1, C2 is set within a range that allows the cover 32 to rotate relative to the inner gear 31 and the sprocket 26 while also providing a dimensional allowance for the sprocket 26, the inner gear 31, and the cover 32 (e.g., approximately 0.1 mm or less).

The ring gear 33, which is substantially cylindrical, is coupled between the inner gear 31 and the sprocket 26. Inner teeth 48 project from the inner circumferential surface of the ring gear 33 while outer teeth 49 project from the outer circumferential surface of the ring gear 33. The teeth 48, 49 are helical splines. The inner teeth 48 are meshed with the outer teeth 38 of the inner gear 31 while the outer teeth 49 are meshed with the inner teeth 40 of the sprocket 26. The ring gear 33 has end faces 50, 51, to which hydraulic pressure is applied.

Space is provided between a left surface 50 of the ring gear 33 and the cover 33 to define a first hydraulic pressure chamber 52. Hydraulic pressure is applied to the left surface 50 in the first hydraulic chamber 52. The first hydraulic chamber 52 is sealed by the contact between the outer surface 42 of the sprocket 26 and the second peripheral edge 56. Space is also provided between a right surface 51 of the ring gear 33, the inner gear 31, and the sprocket 26 to define a second hydraulic pressure chamber 53. The second pressure chamber 53 is sealed by the contact between the second inner surface 44 of the sprocket 26 and the first peripheral edge 57 of the flange 35. A first oil passage 55 extending through the camshaft 17 and the inner gear 31 is connected to the first pressure chamber 52. A second oil passage 54 extending through the camshaft 17 and the inner gear 31 is connected to the second pressure chamber 53. The first and second oil passages 54, 55 are connected to a hydraulic pressure circuit (not shown). Hydraulic pressure is supplied to the pressure chambers 52, 53 through the associated oil passages 54, 55.

When hydraulic pressure is supplied to the first pressure chamber 52 through the oil passage 55 in the state shown in FIG. 1, the pressure moves the left surface 50 of the ring gear 33 toward the right (as viewed in the drawing). The supply of hydraulic pressure is controlled by the hydraulic pressure circuit. The hydraulic pressure in the first pressure chamber 52 rotates and moves the ring gear 33 to the right against the hydraulic pressure in the second pressure chamber 53. This displaces the rotational phase of the sprocket 26 with respect to the rotational phase of the camshaft 17 and advances the valve timing of the intake valve 19 (shown in FIG. 3).

The hydraulic pressure supplied to the first pressure chamber 52 is also supplied to the first clearance C1 through the space between the cover 32 and the ring gear 33. Since the first pressure chamber 52 is sealed by the contact between the second peripheral edge 56 of the cover 32 and the outer surface 42 of the sprocket 26, the oil in the first clearance C1 does not leak externally. The hydraulic pressure in the first clearance C1 presses the first end surface 45 of the sprocket 26 to the right. The magnitude of the pressing force is proportional to the area of the first end surface 45. The rightward movement of the sprocket 26 is restricted by the abutment of the second end surface 47 against the flange 35. The sprocket 26 is pressed to the right as long as hydraulic pressure is supplied to the first pressure chamber 52 even when the movement of the ring gear 33 is completed. This maintains the abutment of the second end surface 47 against the flange 35.

The helical splines convert the torque fluctuation of the camshaft 17 in the rotational direction of the camshaft 17 to force fluctuation in the axial direction of the camshaft 17. However, the sprocket 26 is constantly pressed toward the right as described above despite such force fluctuation acting on the ring gear 33. This prevents chattering and reduces noise that may be caused by the chattering.

When the ring gear 26 is moved to the right from the state shown in FIG. 1, the hydraulic pressure supplied to the second pressure chamber 53 through the oil passage 54 moves the right surface 51 of the ring gear 33 toward the left. The hydraulic pressure in the second pressure chamber 53 rotates and moves the ring gear 33 to the left against the hydraulic pressure in the first pressure chamber 52. This displaces the rotational phase of the sprocket 26 with respect to the rotational phase of the camshaft 17 and retards the valve timing of the intake valve 19 (shown in FIG. 3).

The hydraulic pressure supplied to the second pressure chamber 53 is also supplied to the second clearance C2. Since the second pressure chamber 53 is sealed by the contact between the second inner surface 44 of the sprocket 26 and the first peripheral edge 57 of the inner gear 31, the oil in the second clearance C2 does not leak externally. The hydraulic pressure in the second clearance C2 presses the sprocket 26 to the left (as viewed in the drawing). The hydraulic pressure in the second pressure chamber 53 presses the intermediate surface 46 to the right. As shown in FIG. 2, the area of the intermediate surface 46 is greater by an area b than the area of the second end surface 47. The magnitudes of the forces acting on the intermediate surface 46 and the second end surface 47 are proportional to their respective areas. In addition, the forces acting on each surface 46, 47 are directed in opposite directions. Accordingly, the intermediate surface 46, which has an area that is greater than the second end surface 47 by area b, receives a force that is greater than that received by the second end surface 47. This results in a force proportional to the area b pressing the sprocket 26 toward the right until the movement of the sprocket 26 is restricted by the abutment between the second end surface 47 and the flange 35. The sprocket 26 is kept pressed to the right as long as hydraulic pressure is supplied to the second pressure chamber 53 even when the movement of the ring gear 33 is completed. This maintains the abutment of the second end surface 47 against the flange 35.

Accordingly, this prevents chattering and reduces noise that may be caused by the chattering.

The magnitude of the force that presses the sprocket 26 to the right is sufficient for offsetting the axial force acting on the ring gear 33 that is produced by the torque fluctuation of the camshaft 17. In addition, the magnitude of the force is small enough to prevent a significant increase in the frictional force produced between the second end surface 47 and the flange 35.

The supply of hydraulic pressure to the first and second pressure chambers 52, 53 is controlled by the hydraulic pressure circuit. The ring gear 33 is moved to the left and to the right by appropriately controlling the hydraulic pressure supplied to the first and second pressure chambers 52, 53. When the hydraulic pressure in the first pressure chamber 52 is substantially equal to the hydraulic pressure in the second chamber 53, the ring gear 33 is held fixed at one position. In this case, the movement of the sprocket 26 is restricted by the abutment against the flange 35 even when the hydraulic pressure in the first pressure chamber 52 is substantially equal to the hydraulic pressure in the second chamber 53. Accordingly, this prevents chattering and reduces noise that may be caused by the chattering. Continuous (non-stage) hydraulic pressure control enables continuous changes in the valve timing of the intake valve 19 (FIG. 3). The valve timing may also be changed through two-stage or multiple-stage hydraulic control.

The force that presses the sprocket 26 to the right may be altered by appropriately altering the areas of the first end surface 45, the intermediate surface 46, and the second end surface 47. Such alterations adjust the forces used to offset the torque fluctuation force acting on the sprocket 26 to a desirable level. For example, such an adjustment may be used to suppress the friction produced between the second end surface 47 and the flange 35 of the inner gear 31 to ensure an immediate response by the VVT 11.

Although only one embodiment of the present invention has been described herein, it should be apparent to those skilled in the art that the present invention may be embodied in many other specific forms without departing from the spirit or scope of the invention.

Each of the sprockets 24, 25, 26 may be replaced with timing pulleys and the chain 27 may be replaced with a timing belt.

The present invention is employed in a VVT that alters the rotational phase of the camshaft. However, the present invention may be employed in a VVT that rotates the camshaft to alter the rotational phase of the sprocket. In such a VVT, the basal end of the camshaft is coupled to the crankshaft while the sprocket is rotated relative to the camshaft by coupling the camshaft to another sprocket.

Although the present invention is employed in a VVT that changes the timing of the intake valve, the present invention may also be employed in a VVT that changes the timing of the exhaust valve.

Therefore, the present examples and embodiments are to be considered as illustrative and not restrictive and the invention is not to be limited to the details given herein, but may be modified within the scope of the appended claims.

What is claimed is:

1. An apparatus for adjusting the valve timing of at least one of an intake valve and an exhaust valve of an engine, the apparatus comprising:

a camshaft for actuating one of said intake valve and said exhaust valve;

a rotary member surrounding a distal end of said camshaft, said rotary member having a first surface and a second surface for respectively receiving fluid pressure from opposite directions;

a gear member positioned between said camshaft and said rotary member, said gear member being arranged to move in an axial direction to change the relative rotational relationship between said camshaft and said rotary member;

a first cover fixed to the distal end of the camshaft, wherein said first cover defines a first chamber between the first cover and the gear member for receiving fluid pressure to move the gear member axially;

a second cover fixed to the camshaft, wherein said second cover defines a second chamber between the second cover and the gear member for receiving fluid pressure to move said gear axially;

a first clearance defined between the first surface and the first cover to communicate with the first chamber;

a second clearance defined between the second surface and the second cover to communicate with the second chamber; and a third surface provided on said rotary member between the first surface and the second surface, said third surface being arranged to receive a force resulting from fluid pressure directed opposite to a force resulting from the fluid pressure received by the second surface, wherein said third surface has an area greater than that of said second surface.

2. The apparatus as set forth in claim 1, further comprising:

first outer teeth fixed to the camshaft;

first inner teeth fixed to the rotary member;

a ring gear formed by said gear member;

second outer teeth fixed to the ring gear, wherein said second outer teeth engage the first inner teeth for forming an outer coupling;

second inner teeth fixed to the ring gear, wherein said second inner teeth engage the first outer teeth for forming an inner coupling;

a helical spline included in at least one of the outer gear coupling and the inner gear coupling.

3. The apparatus as set forth in claim 2, wherein said rotary member comprises an outer surface and a first inner surface adjacent to said first surface, and a second inner surface adjacent to said second surface, and wherein said first inner surface has a diameter greater than that of said second inner surface.

4. The apparatus as set forth in claim 3, wherein said first cover has a first peripheral surface for sealing said first cover with respect to said rotary member by contacting said outer surface of said rotary member.

5. The apparatus as set forth in claim 4, wherein said second cover has a second peripheral surface for sealing said second cover with respect to said rotary member by contacting said second inner surface of said rotary member.

6. The apparatus as set forth in claim 5, further comprising driving means for driving the rotary member by transmitting power from the engine to the rotary member.

7. The apparatus as set forth in claim 6, wherein said engine has a crankshaft, and said driving means includes transmission means for connecting the crankshaft to the rotary member.

8. The apparatus as set forth in claim 7, wherein said rotary member includes a sprocket, and wherein said transmission means includes a chain.

9. The apparatus as set forth in claim 1, wherein said camshaft selectively opens and closes said intake valve.

10. An apparatus for adjusting the valve timing of at least one of an intake valve and an exhaust valve of an engine, the apparatus comprising:

a camshaft for actuating one of said intake valve and said exhaust valve;

a rotary member surrounding a distal end of said camshaft, said rotary member having a first surface and a second surface for respectively receiving fluid pressure from opposite directions;

a gear member positioned between said camshaft and said rotary member, said gear member being arranged to move in an axial direction to change the relative rotational relationship between said camshaft and said rotary member;

a first cover fixed to the distal end of the camshaft, wherein said first cover defines a first chamber between the first cover and the gear member for receiving fluid pressure to move the gear member axially;

a second cover fixed to the camshaft, wherein said second cover defines a second chamber between the second cover and the gear member for receiving fluid pressure to move said gear axially;

a first clearance defined between the first surface and the first cover to communicate with the first chamber;

a second clearance defined between the second surface and the second cover to communicate with the second chamber;

a third surface provided on said rotary member between the first surface and the second surface, said third surface being arranged to receive a force resulting from fluid pressure directed opposite to a force resulting from the fluid pressure received by the second surface;

a first inner surface provided on the rotary member adjacent to said first surface; and a second inner surface provided on the rotary member adjacent to said second surface, wherein said first inner surface has a diameter greater than that of said second inner surface, and wherein said engine comprises a crankshaft, and the torque of said crankshaft actuates said apparatus.

11. The apparatus as set forth in claim 10, wherein said rotary member has an outer surface and wherein said first cover has a first peripheral surface for sealing said first cover with respect to said rotary member by contacting said outer surface of said rotary member, and wherein said second cover has a second peripheral surface for sealing said second cover with respect to said rotary member by contacting said second inner surface of said rotary member.

* * * * *